US010755878B1

(12) United States Patent
Liu

(10) Patent No.: US 10,755,878 B1
(45) Date of Patent: Aug. 25, 2020

(54) KEYBOARD DEVICE

(71) Applicant: Primax Electronics Ltd., Taipei (TW)

(72) Inventor: Chien-Hung Liu, Taipei (TW)

(73) Assignee: PRIMAX ELECTRONICS LTD., Taipei (TW)

( * ) Notice: Subject to any disclaimer, the term of this patent is extended or adjusted under 35 U.S.C. 154(b) by 0 days.

(21) Appl. No.: 16/448,530

(22) Filed: Jun. 21, 2019

(30) Foreign Application Priority Data

Feb. 15, 2019 (TW) ..... 108105171 A

(51) Int. Cl.
*H01H 13/84* (2006.01)
*H01H 13/7065* (2006.01)

(52) U.S. Cl.
CPC ..... *H01H 13/84* (2013.01); *H01H 13/7065* (2013.01); *H01H 2233/07* (2013.01)

(58) Field of Classification Search
CPC . H01H 13/84; H01H 13/7065; H01H 2233/07
USPC ..... 200/5 A, 517
See application file for complete search history.

(56) References Cited

U.S. PATENT DOCUMENTS 5,504,283 A * 4/1996 Kako ..... H01H 3/125 200/344
6,366,275 B1 * 4/2002 Lai ..... H01H 3/125 200/344
9,715,977 B1 * 7/2017 Liu ..... H01H 3/125
2012/0318656 A1 * 12/2012 Chen ..... H01H 13/83 200/517

* cited by examiner

*Primary Examiner* — Nguyen Tran
*Assistant Examiner* — Iman Malakooti
(74) *Attorney, Agent, or Firm* — Kirton McConkie; Evan R. Witt

(57) ABSTRACT

A keyboard device includes keyboard device includes a membrane circuit board, a base plate and a key structure. The key structure includes a keycap, a connecting element, an elastic element and a buffering structure. The connecting element is arranged between the base plate and the keycap. The elastic element is arranged between the keycap and the membrane circuit board. The buffering structure is disposed on a bottom surface of the keycap. While the keycap is depressed, the buffering structure collides with the elastic element or the connecting element. Consequently, the buffering structure provides a buffering effect.

11 Claims, 14 Drawing Sheets

KEYBOARD DEVICE

FIELD OF THE INVENTION

The present invention relates to an input device, and more particularly to a keyboard device.

BACKGROUND OF THE INVENTION

Generally, the widely-used peripheral input device of a computer system includes for example a mouse device, a keyboard device, a trackball device, or the like. Via the keyboard device, characters or symbols can be inputted into the computer system directly. As a consequence, most users and most manufacturers of input devices pay much attention to the development of keyboard devices.

The structures and the functions of a conventional keyboard device 1 will be illustrated as follows. Please refer to FIGS. 1, 2, 3 and 4. FIG. 1 is a schematic perspective view illustrating the outer appearance of a conventional keyboard device. FIG. 2 is a schematic exploded view illustrating a portion of the keyboard device as shown in FIG. 1 and taken along a viewpoint. FIG. 3 is a schematic exploded view illustrating a portion of the keyboard device as shown in FIG. 1 and taken along another viewpoint. FIG. 4 is a schematic cross-sectional view illustrating a portion of the keyboard device as shown in FIG. 1. For succinctness, only one key structure and the related components are shown in FIGS. 1, 2, 3 and 4. In practice, the keyboard device comprises one or more than one key structure.

The conventional keyboard device 1 comprises plural key structures 10, a base plate 11 and a membrane circuit board 12. The membrane circuit board 12 is arranged between the key structures 10 and the base plate 11. Each key structure 10 comprises a keycap 101, a connecting element 102 and an elastic element 103. The connecting element 102 is connected between the keycap 101 and the base plate 11. Consequently, the keycap 101 is movable upwardly or downwardly relative to the base plate 11. The elastic element 103 is arranged between the keycap 101 and the base plate 11. Moreover, the elastic element 103 comprises a contacting part 1031. For example, the connecting element 102 is a scissors-type connecting element. Moreover, the connecting element 102 comprises a first frame 1021 and a second frame 1022. The second frame 1022 is pivotally coupled to the first frame 1021. Each keycap 101 comprises a locking part 1011 and a hooking part 1012.

The base plate 11 comprises a first hook 111 and a second hook 112. The first hook 111 and the second hook 112 are protruded upwardly and penetrated through the corresponding circuit board openings 125 of the membrane circuit board 12. A first end of the first frame 1021 is connected with the hooking part 1012 of the keycap 101. A second end of the first frame 1021 is connected with the second hook 112 of the base plate 11. A first end of the second frame 1022 is connected with the locking part 1011 of the keycap 101. A second end of the second frame 1022 is connected with the first hook 111 of the base plate 11. Due to the above design, the first frame 1021 and the second frame 1022 can be swung relative to each other. That is, the first frame 1021 and the second frame 1022 are selectively switched from a stacked state to an open-scissors state or switched from the open-scissors state to the stacked state.

The membrane circuit board 12 comprises plural membrane switches 121. While the keycap 101 of any key structure 10 is depressed and moved downwardly relative to the base plate 11, the first frame 1021 and the second frame 1022 of the connecting element 102 are switched from the open-scissors state to the stacked state. As the keycap 101 is moved downwardly to compress the elastic element 103, the corresponding membrane switch 121 is contacted and pushed by the contacting part 1031 of the elastic element 103. Consequently, the corresponding membrane switch 121 is triggered, and the keyboard device 1 generates a corresponding key signal. When the keycap 101 of the key structure 10 is no longer depressed, the keycap 101 is moved upwardly relative to the base plate 11 in response to an elastic force of the elastic element 103. Meanwhile, the first frame 1021 and the second frame 1022 are switched from the stacked state to the open-scissors state again, and the keycap 101 is returned to its original position.

However, the conventional keyboard device 1 still has some drawbacks. While the keycap 101 of any key structure 10 is depressed and moved downwardly relative to the base plate 11, the keycap 101 collides with the connecting element 102 and the membrane circuit board 12. Under this circumstance, a click sound is generated. When the kinetic energy resulted from collision is transferred downwardly to the metallic base plate 11, the sound is the unpleasant noise to the user. In other words, the conventional keyboard device needs to be further improved.

SUMMARY OF THE INVENTION

An object of the present invention provides a keyboard device having a function of reducing noise. A key structure of the keyboard device includes a keycap, a connecting element and an elastic element. A buffering structure is disposed on a bottom surface of the keycap. While the keycap is depressed, the buffering structure collides with the elastic element or the connecting element of the keycap. Since the buffering structure provides a buffering effect, the noise reducing function is achieved.

In accordance with an aspect of the present invention, a keyboard device is provided. The keyboard device includes a membrane circuit board, a base plate and a key structure. The membrane circuit board includes a membrane switch. The base plate is located under the membrane circuit board. The key structure includes a keycap, a connecting element, an elastic element and a buffering structure. The keycap is located over the membrane circuit board. The connecting element is connected between the base plate and the keycap. The keycap is movable upwardly or downwardly relative to the base plate through the connecting element. The elastic element is arranged between the keycap and the membrane circuit board, and includes a contacting part. While the keycap is depressed, the elastic element is compressed and the membrane switch is triggered by the contacting part. When the keycap is not depressed, the keycap is returned to an original position in response to an elastic force of the elastic element. The buffering structure is disposed on a bottom surface of the keycap. While the keycap is depressed, the buffering structure collides with the elastic element or the connecting element, so that the buffering structure provides a buffering effect.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

Figure 1:
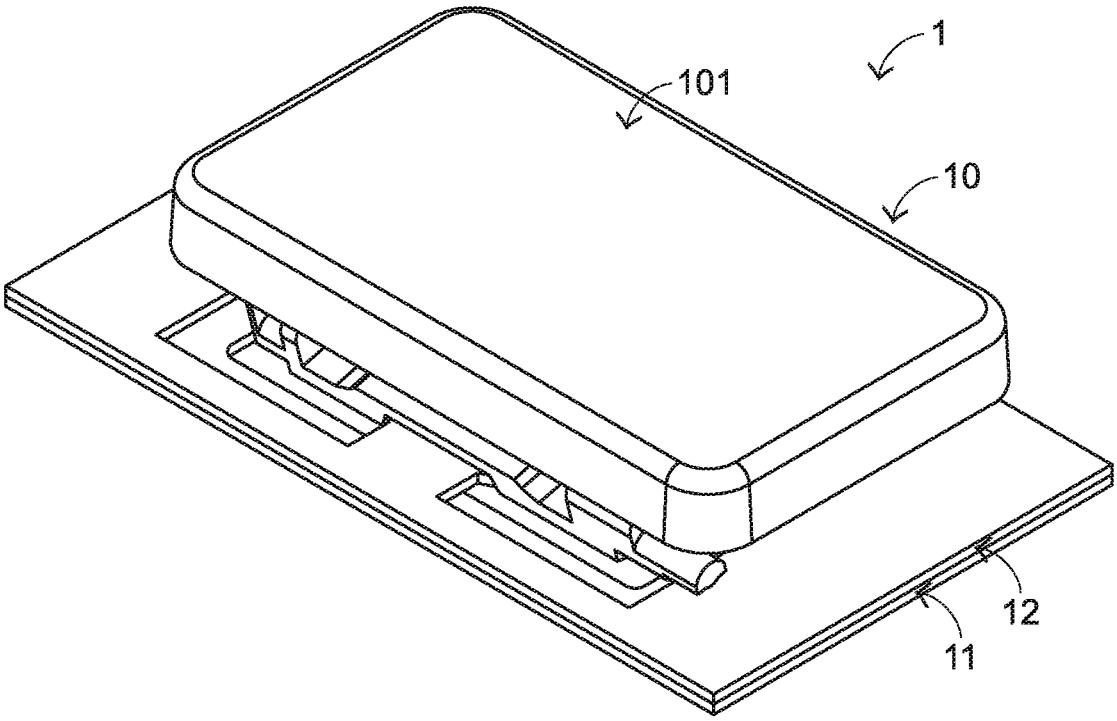
FIG.1 PRIOR ART
FIG. 1 is a schematic perspective view illustrating the outer appearance of a conventional keyboard device.
Figure 2:
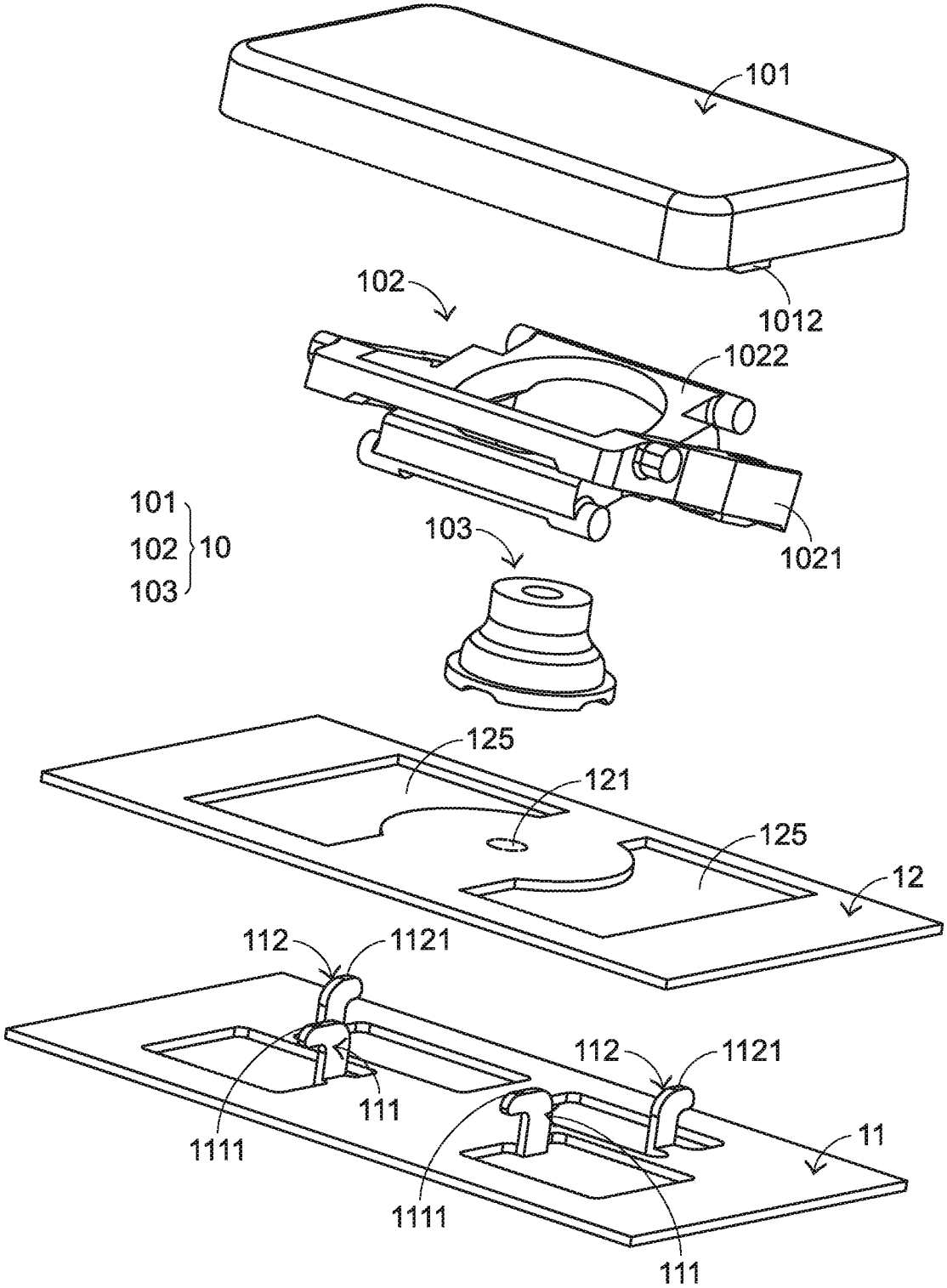
FIG.2 PRIOR ART
FIG. 2 is a schematic exploded view illustrating a portion of the keyboard device as shown in FIG. 1 and taken along a viewpoint.
Figure 3:
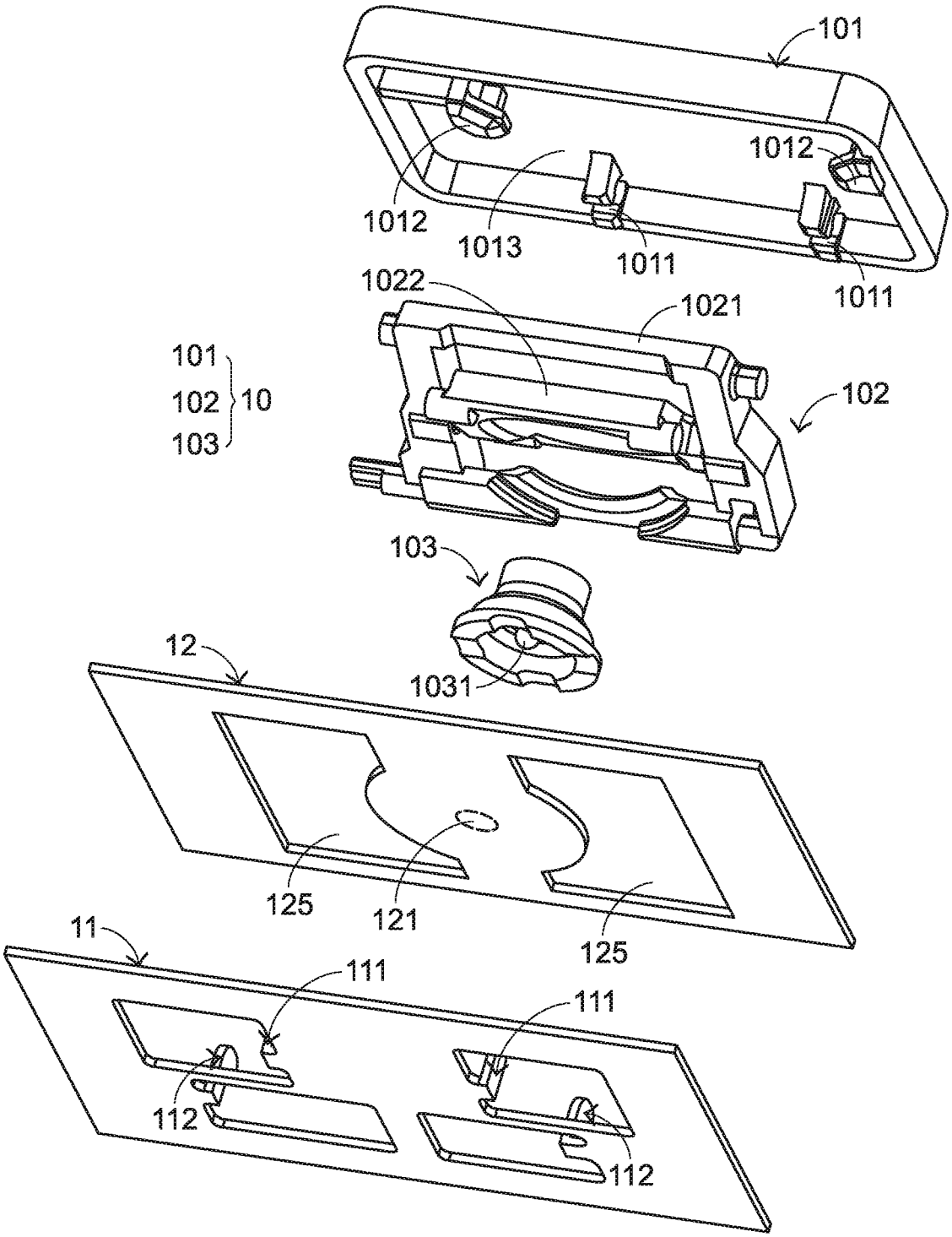
FIG.3 PRIOR ART
FIG. 3 is a schematic exploded view illustrating a portion of the keyboard device as shown in FIG. 1 and taken along another viewpoint.
Figure 4:
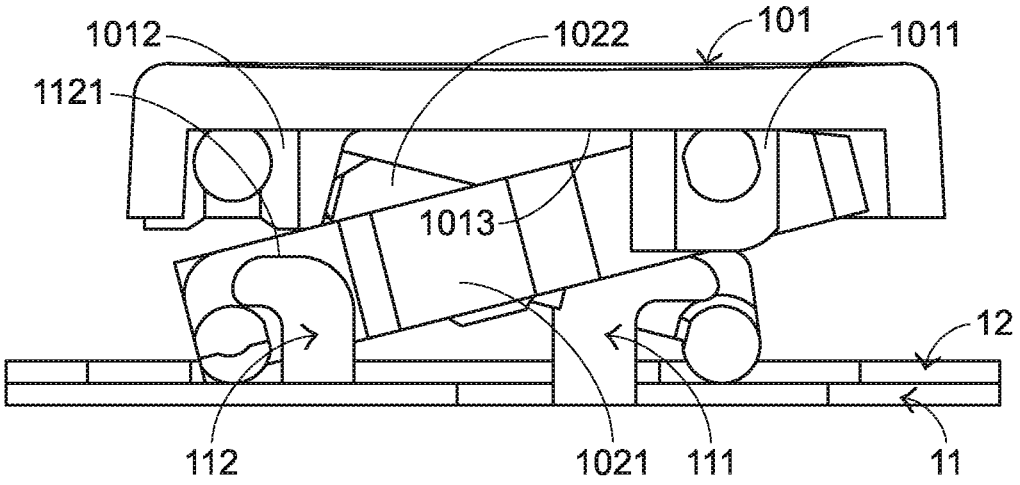
FIG.4 PRIOR ART
FIG. 4 is a schematic cross-sectional view illustrating a portion of the keyboard device as shown in FIG. 1.
Figure 5:
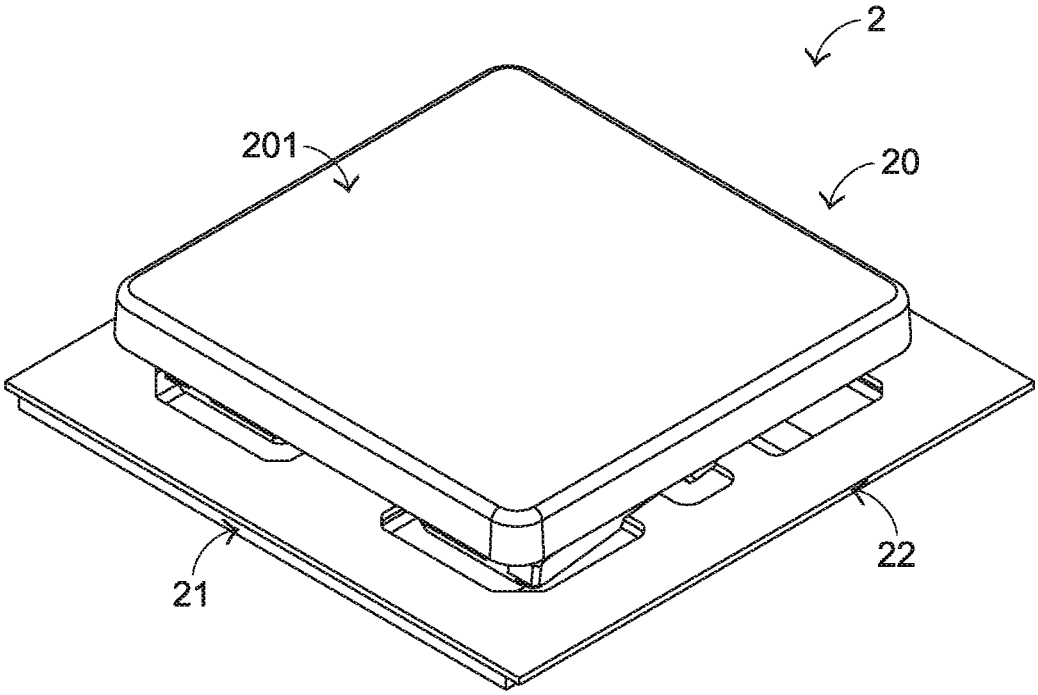
FIG. 5 is a schematic perspective view illustrating the outer appearance of a keyboard device according to a first embodiment of the present invention.
Figure 6:
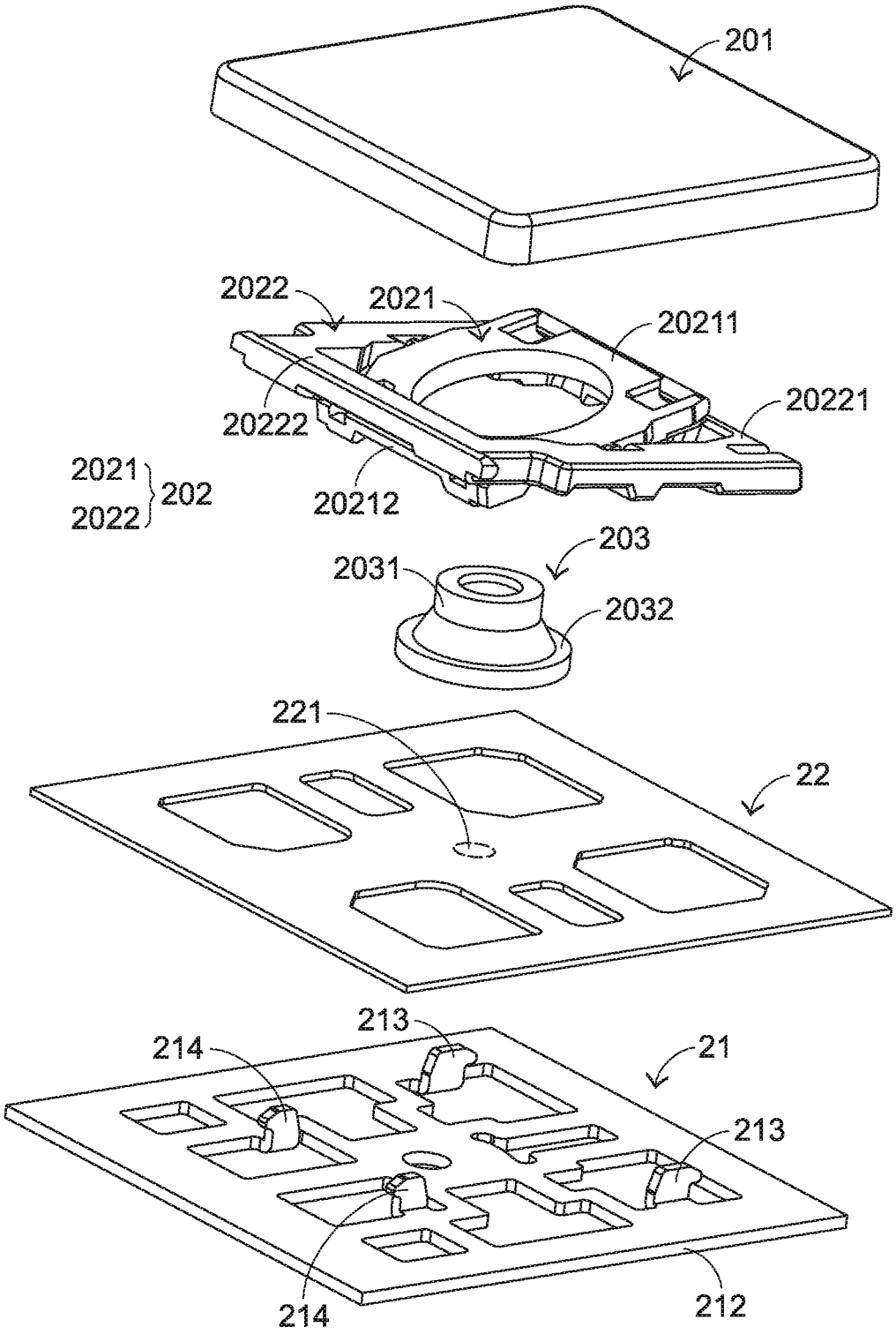
FIG. 6 is a schematic exploded view illustrating a portion of the keyboard device as shown in FIG. 5 and taken along a viewpoint.
Figure 7:
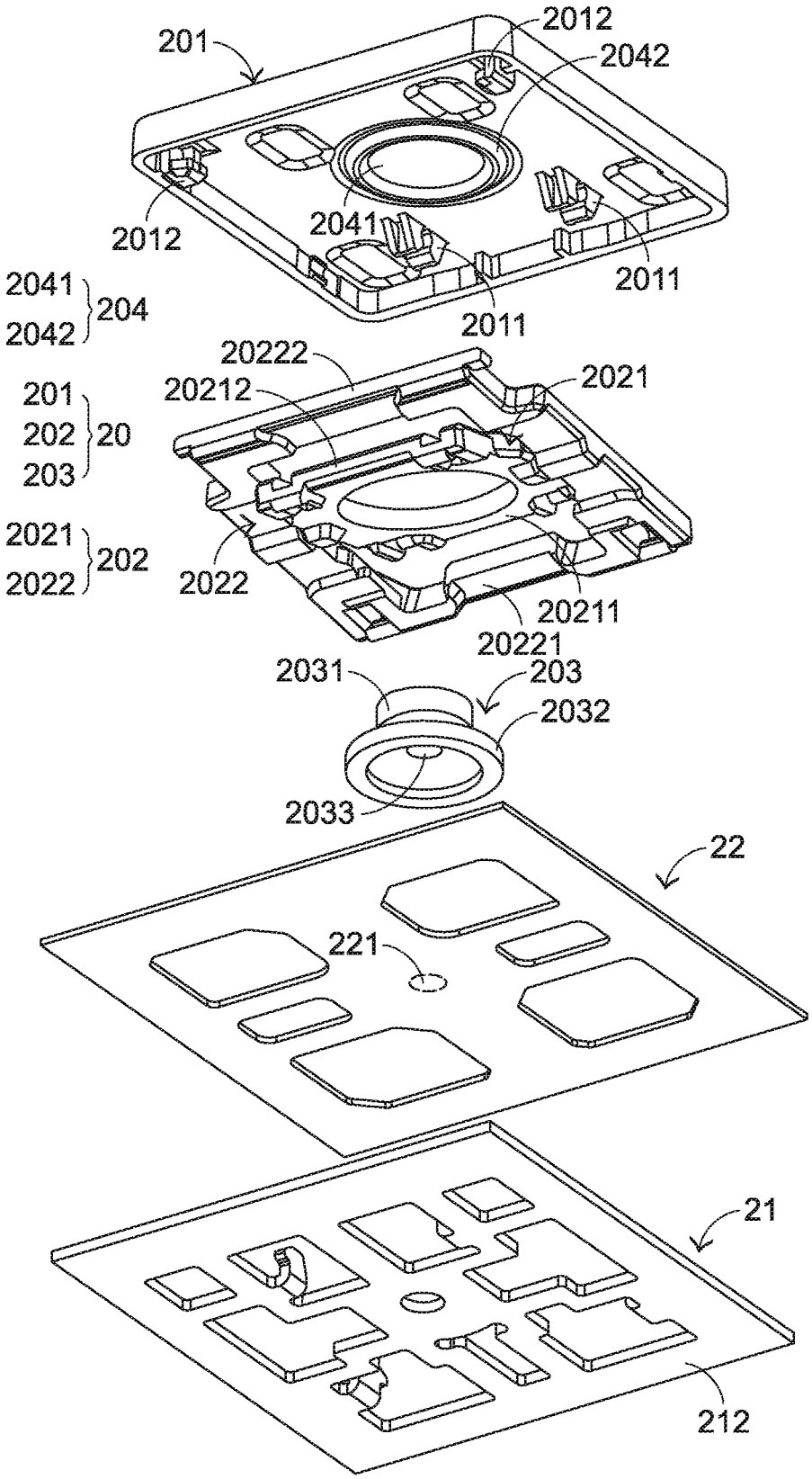
FIG. 7 is a schematic exploded view illustrating a portion of the keyboard device as shown in FIG. 5 and taken along another viewpoint.
Figure 8:
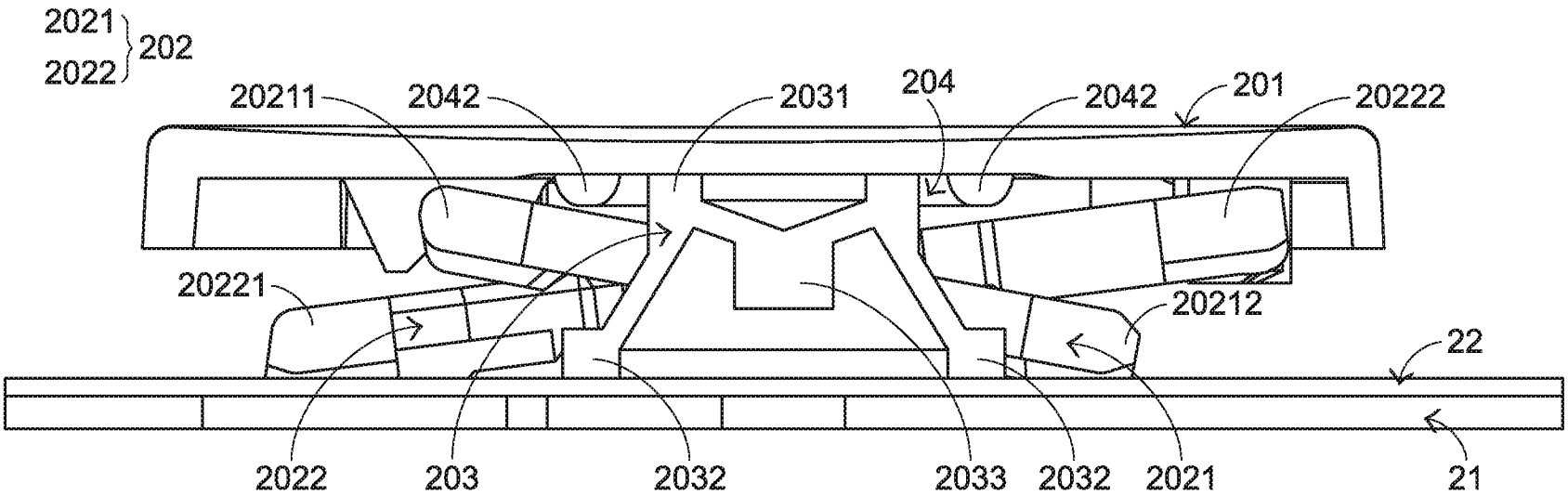
FIG. 8 is a schematic cross-sectional view illustrating a portion of the keyboard device as shown in FIG. 5.

Please refer to FIGS. 5, 6, 7 and 8. FIG. 5 is a schematic perspective view illustrating the outer appearance of a keyboard device according to a first embodiment of the present invention. FIG. 6 is a schematic exploded view illustrating a portion of the keyboard device as shown in FIG. 5 and taken along a viewpoint. FIG. 7 is a schematic exploded view illustrating a portion of the keyboard device as shown in FIG. 5 and taken along another viewpoint. FIG. 8 is a schematic cross-sectional view illustrating a portion of the keyboard device as shown in FIG. 5. For succinctness, only one key structure and the related components are shown in FIGS. 5, 6, 7 and 8. In practice, the keyboard device comprises more than one key structure.

The keyboard device 2 comprises plural key structures 20, a base plate 21 and a membrane circuit board 22. These key structures 20 are classified into some types, e.g., ordinary keys, numeric keys and function keys. When one of the key structures 20 is depressed by the user's finger, a corresponding key signal is generated to the computer (not shown), and thus the computer executes a function corresponding to the depressed key structure. For example, when an ordinary key is depressed, a corresponding English letter or symbol is inputted into the computer. When a numeric key is depressed, a corresponding number is inputted into the computer. In addition, the function keys (F1~F12) can be programmed to provide various quick access functions.

Figure 9:
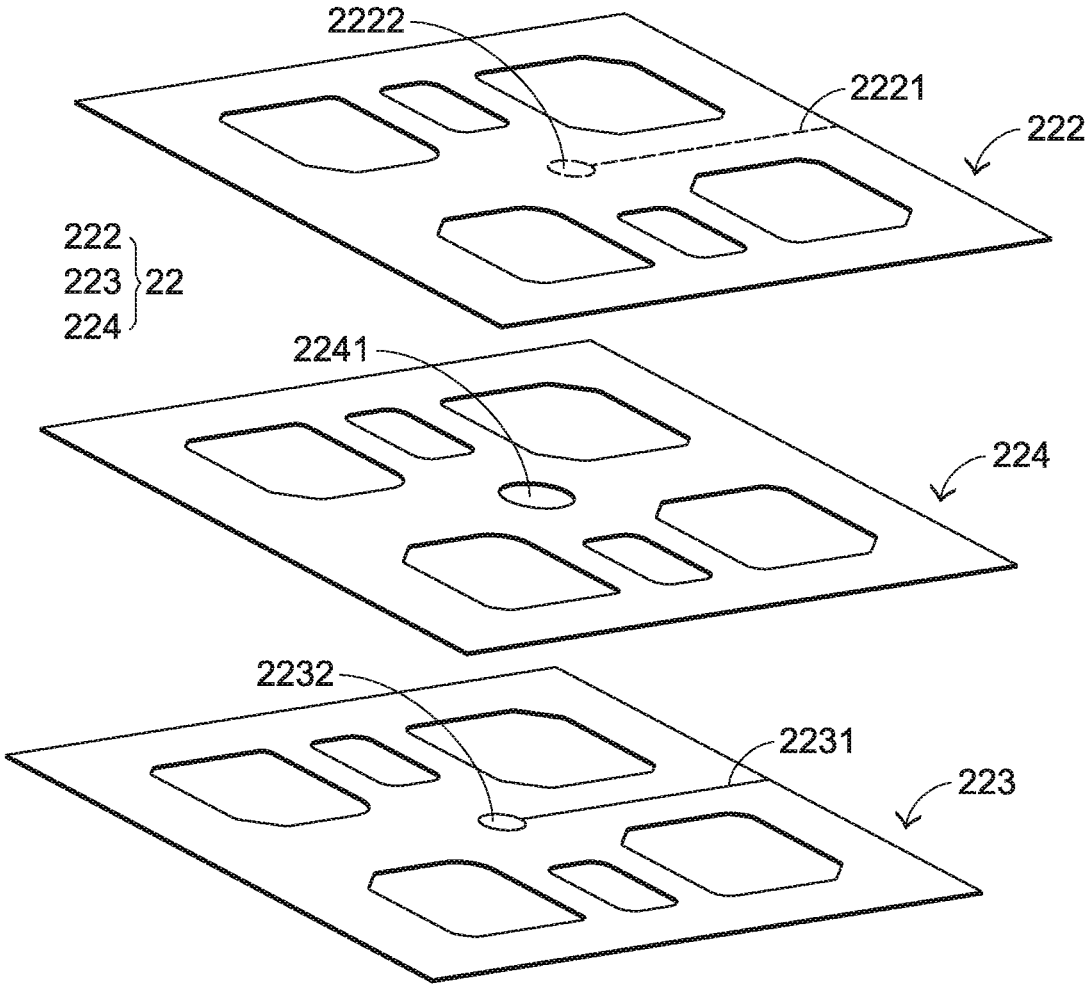
FIG. 9 is a schematic exploded view illustrating the membrane circuit board of the keyboard device as shown in FIG. 5.

FIG. 9 is a schematic exploded view illustrating the membrane circuit board of the keyboard device as shown in FIG. 5. The membrane circuit board 22 comprises plural film layers. The thickness of each film layer is presented herein for purpose of illustration and description only. For succinctness, only one upper contact, one lower contact and one perforation are shown in FIG. 9. The membrane circuit board 22 comprises an upper film layer 222, a lower film layer 223 and an intermediate film layer 224, which are arranged in a stack form. A first circuit pattern 2221 is formed on a bottom surface of the upper film layer 222. The first circuit pattern 2221 comprises plural upper contacts 2222 corresponding to the plural key structures 20. A second circuit pattern 2231 is formed on a top surface of the lower film layer 223. The second circuit pattern 2231 comprises plural lower contacts 2232 corresponding to the plural upper contacts 2222. Each of the upper contacts 2222 and the corresponding lower contact 2232 are separated from each other by a spacing distance. Moreover, each of the upper contacts 2222 and the corresponding lower contact 2232 are collectively defined as a membrane switch 221. For maintaining the spacing distance between each upper contact 2222 and the corresponding lower contact 2232, the intermediate film layer 224 is arranged between the upper film layer 222 and the lower film layer 223. In addition, the intermediate film layer 224 comprises plural perforations 2241 corresponding to the plural upper contacts 2222 and the plural lower contacts 2232. Preferably but not exclusively, each of the upper film layer 222, the lower film layer 223 and the intermediate film layer 224 is made of polycarbonate (PC), polyethylene terephthalate (PET), polymethylmethacrylate (PMMA), polyurethane (PU) or polyimide (PI).

Each key structure 20 comprises a keycap 201, a connecting element 202, an elastic element 203 and a buffering structure 204. The connecting element 202 is connected between the keycap 201 and the base plate 21. Through the connecting element 202, the keycap 201 is movable upwardly or downwardly relative to the base plate 21. The elastic element 203 is arranged between the keycap 201 and the membrane circuit board 22. Moreover, the elastic element 203 comprises a contacting part 2033. The buffering structure 204 is disposed on a bottom surface of the keycap 201. In an embodiment, the buffering structure 204 is integrally formed with the keycap 201. Alternatively, after the keycap 201 and the buffering structure 204 are separately produced, the keycap 201 and the buffering structure 204 are combined together. Preferably but not exclusively, the buffering structure 204 is formed on the keycap 201 by using a double injection process, a screen printing process, a transfer printing process, a dispensing process or an adhesive attaching process.

In an embodiment, the shape of the elastic element 203 is similar to a dome shape. The elastic element 203 comprises a raised part 2031 and a periphery part 2032. The buffering structure 204 is a ring-shaped structure, which is protruded downwardly from the bottom surface of the keycap 201. The ring-shaped structure 204 comprises a hollow part 2041 and an outer ring 2042. The outer ring 2042 is arranged around the hollow part 2041. The raised part 2031 of the elastic element 203 is penetrated through the hollow part 2041 of the ring-shaped structure 204 and contacted with the keycap 201.

Moreover, the keycap 201 comprises fixed hooks 2011 and movable hooks 2012. The fixed hooks 2011 and the movable hooks 2012 are disposed on the bottom surface of the keycap 201. In an embodiment, the connecting element 202 is a scissors-type connecting element. Moreover, the connecting element 202 comprises a first frame 2021 and a second frame 2022. The second frame 2022 is pivotally coupled to the first frame 2021. The first frame 2021 is an inner frame, and the second frame 2022 is an outer frame.

The base plate 21 comprises a plate body 212, plural first base plate hooks 213 and plural second base plate hooks 214. The plate body 212 is located under the membrane circuit board 22. The plural first base plate hooks 213 and the plural second base plate hooks 214 are protruded upwardly from the plate body 212 and penetrated through the membrane circuit board 22.

The first end 20211 of the first frame 2021 is connected with the corresponding fixed hook 2011 of the keycap 201. The second end 20212 of the first frame 2021 is connected with the second base plate hook 214 of the base plate 21. The first end 20221 of the second frame 2022 is connected with the corresponding first base plate hook 213 of the base plate 21. The second end 20222 of the second frame 2022 is connected with the movable hook 2012 of the keycap 201. Due to the above structure, the first frame 2021 and the second frame 2022 can be swung relative to each other. Consequently, the first frame 2021 and the second frame 2022 are switched from a stacked state to an open-scissors state or switched from the open-scissors state to the stacked state. The connecting relationships between the connecting element 202, the base plate 21 and the keycap 201 are presented herein for purpose of illustration and description only.

Figure 10:
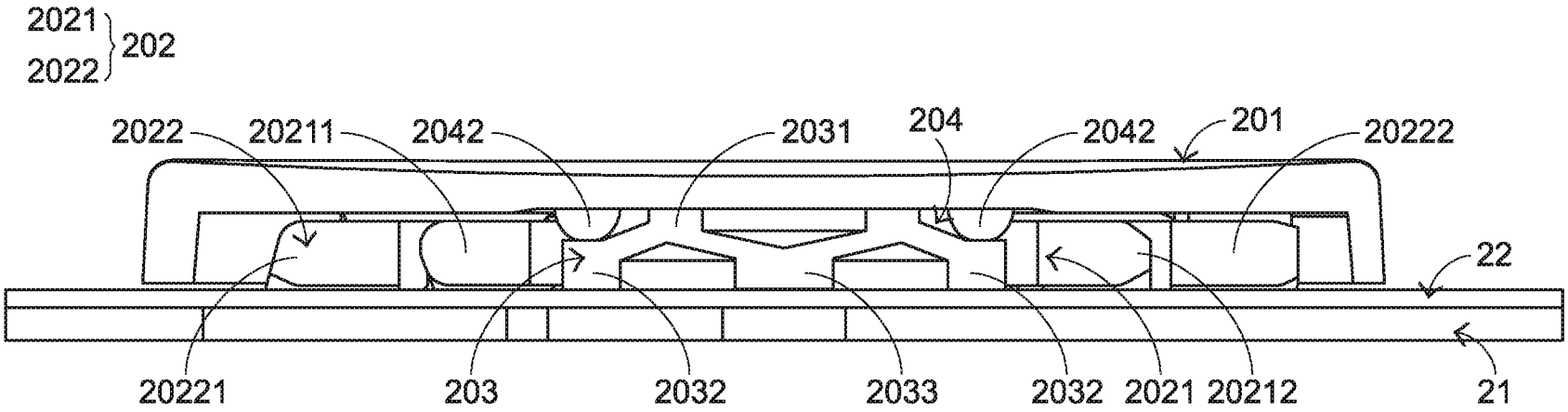
FIG. 10 is a schematic cross-sectional view illustrating a portion of the keyboard device as shown in FIG. 5, in which the keycap of the key structure is depressed.

FIG. 10 is a schematic cross-sectional view illustrating a portion of the keyboard device as shown in FIG. 5, in which the keycap of the key structure is depressed. While the keycap 201 of any key structure 20 is depressed and moved downwardly relative to the base plate 21, the first frame 2021 and the second frame 2022 of the connecting element 202 are switched from the open-scissors state to the stacked state. Moreover, as the keycap 201 is moved downwardly to compress the elastic element 203, the corresponding upper contact 2222 is pushed and triggered by the contacting part 2033 of the elastic element 203. Consequently, the corresponding upper contact 2222 is contacted with the corresponding lower contact 2232 through the corresponding perforation 2241. In such way, the corresponding membrane switch 221 is electrically conducted, and the keyboard device 2 generates a corresponding key signal.

Especially, while the keycap 201 of the key structure 20 is depressed and moved downwardly relative to the base plate 21, the buffering structure 204 on the bottom surface of the keycap 201 is moved downwardly with the keycap 201. Correspondingly, the outer ring 2042 of the buffering structure 204 collides with the periphery part 2032 of the elastic element 203. As a consequence, the impact of the keycap 201 on the membrane circuit board 22 and the generated kinetic energy can be alleviated. Since the sound is reduced while the keycap 201 is depressed, the keyboard device 2 has the efficacy of reducing the noise.

It is noted that numerous modifications and alterations may be made while retaining the teachings of the invention. For example, the shape and structure of the elastic element 203, the shape and structure of the buffering structure 204 and the relative positions between the elastic element 203 and the buffering structure 204 in the depressed state may be modified according to the practical requirements.

Figure 11:
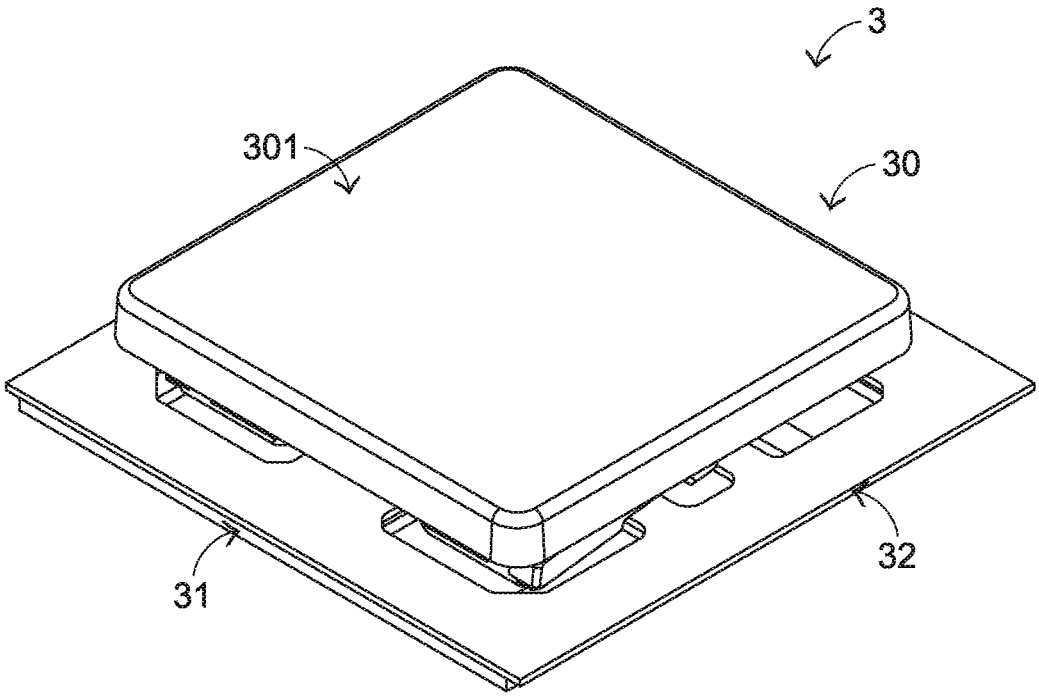
FIG. 11 is a schematic perspective view illustrating the outer appearance of a keyboard device according to a second embodiment of the present invention.
Figure 12:
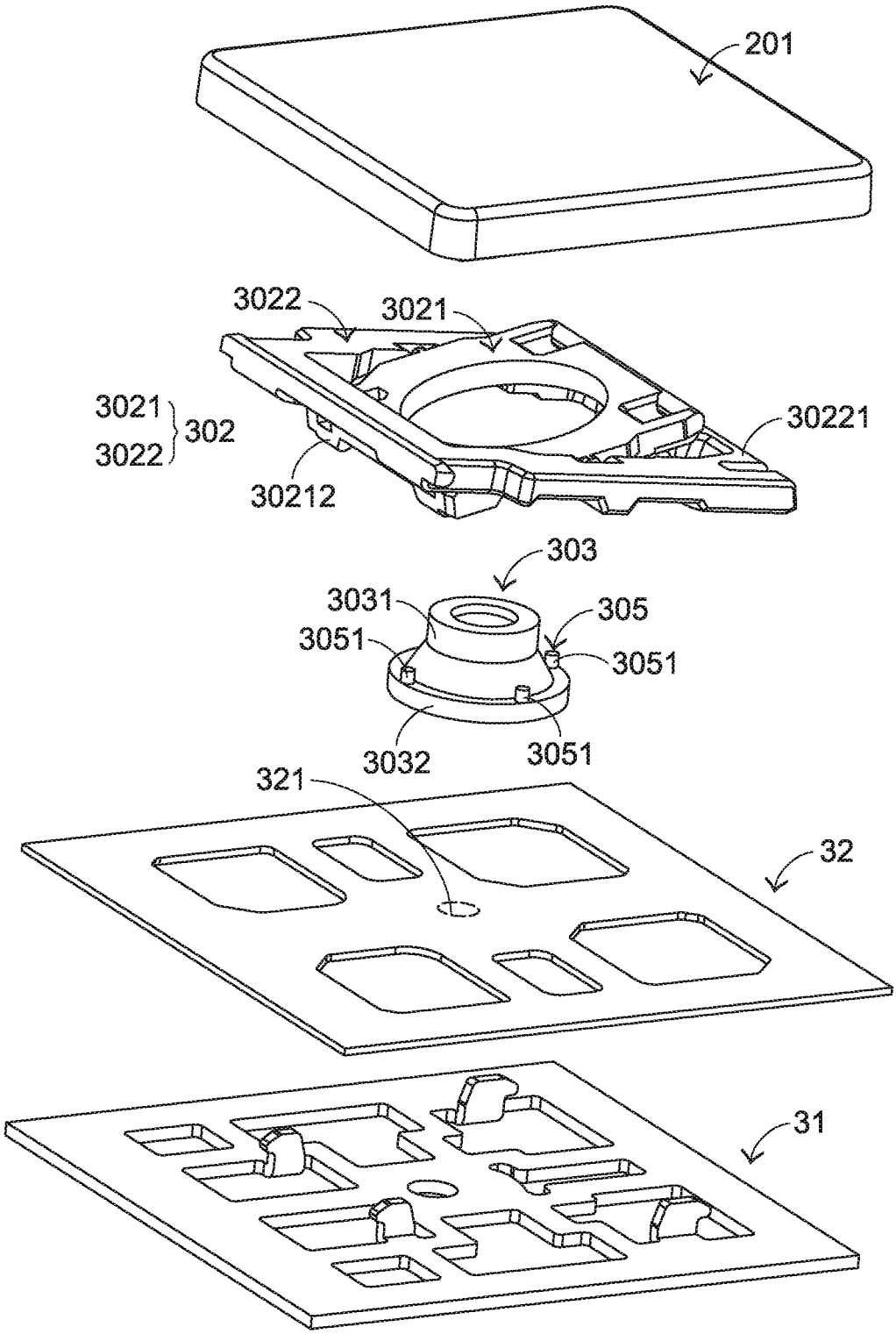
FIG. 12 is a schematic exploded view illustrating a portion of the keyboard device as shown in FIG. 11 and taken along a viewpoint.
Figure 13:
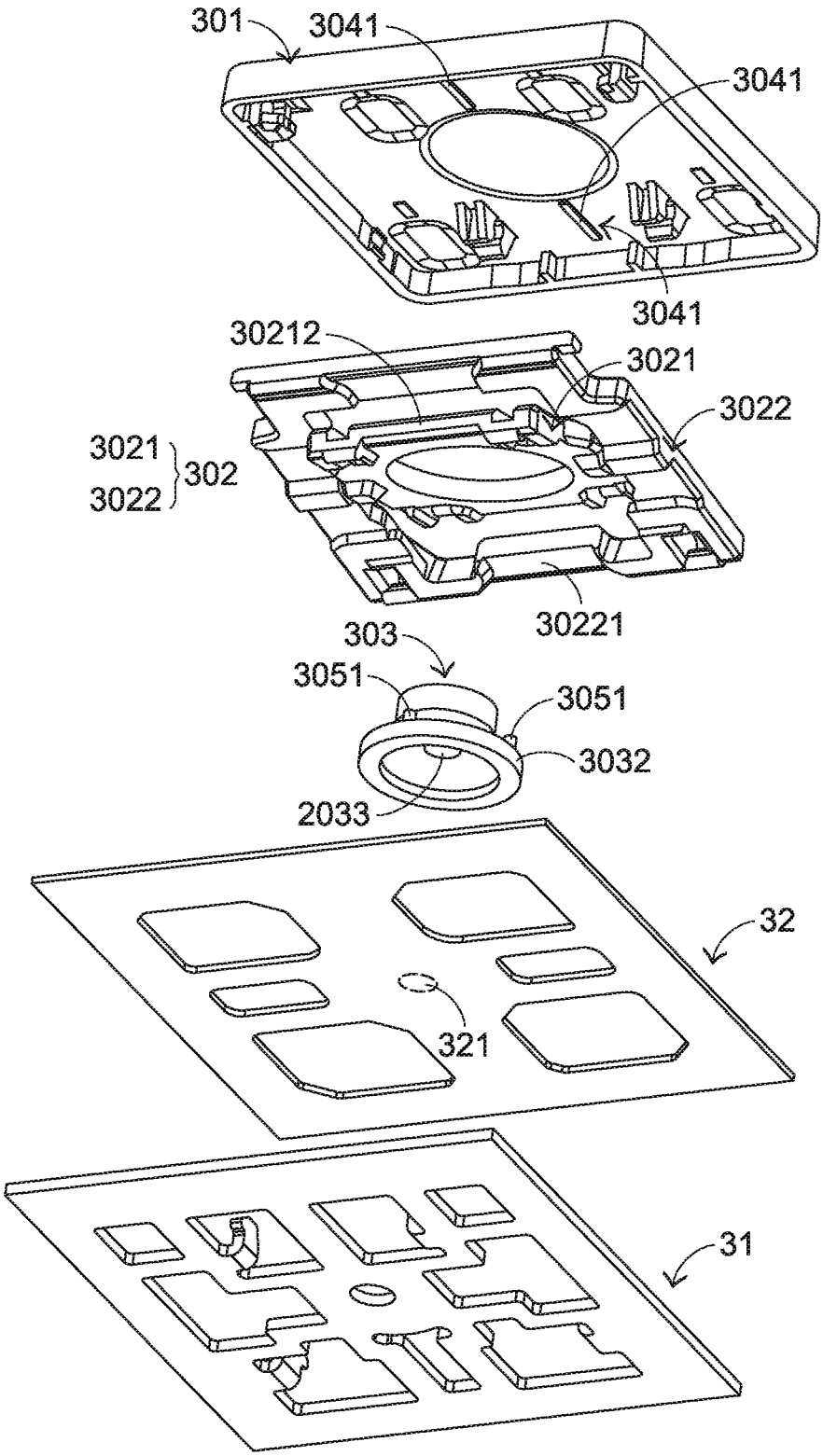
FIG. 13 is a schematic exploded view illustrating a portion of the keyboard device as shown in FIG. 11 and taken along another viewpoint.
Figure 14:
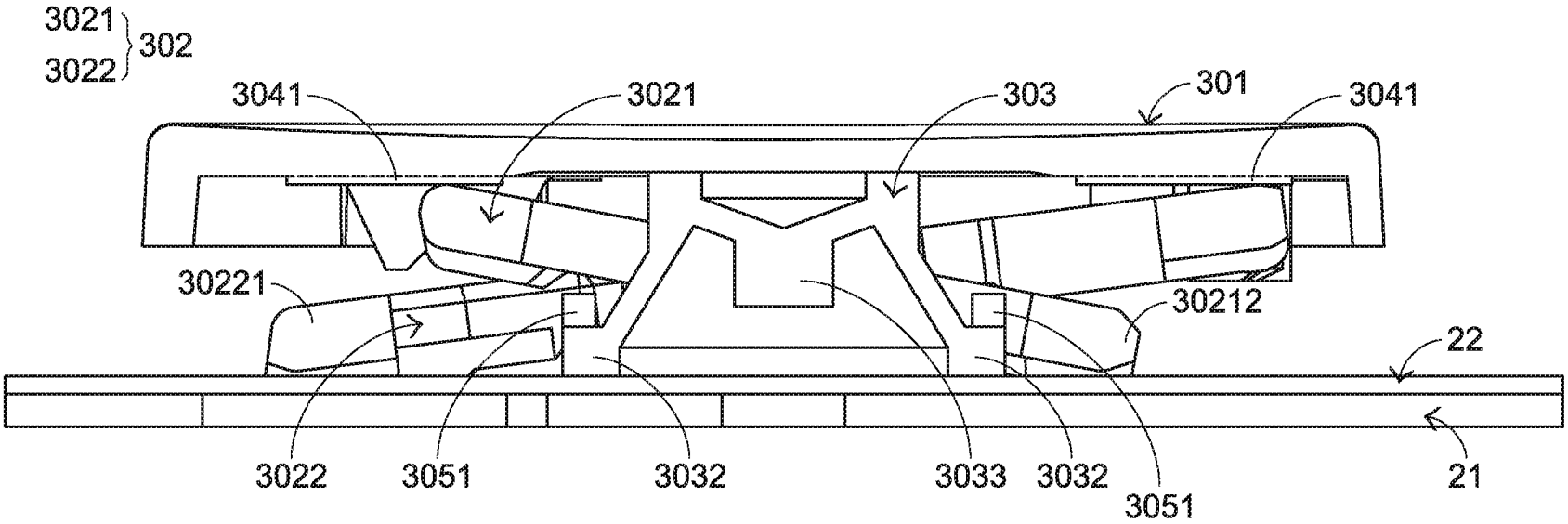
FIG. 14 is a schematic cross-sectional view illustrating a portion of the keyboard device as shown in FIG. 11.

Please refer to FIGS. 11, 12, 13 and 14. FIG. 11 is a schematic perspective view illustrating the outer appearance of a keyboard device according to a second embodiment of the present invention. FIG. 12 is a schematic exploded view illustrating a portion of the keyboard device as shown in FIG. 11 and taken along a viewpoint. FIG. 13 is a schematic exploded view illustrating a portion of the keyboard device as shown in FIG. 11 and taken along another viewpoint. FIG. 14 is a schematic cross-sectional view illustrating a portion of the keyboard device as shown in FIG. 11. For succinctness, only one key structure and the related components are shown in FIGS. 11, 12, 13 and 14 and the following FIG. 15.

The keyboard device 3 comprises plural key structures 30, a base plate 31 and a membrane circuit board 32. Each key structure 30 comprises a keycap 301, a connecting element 302, an elastic element 303 and a buffering structure 304. The structures and functions of the components of the keyboard device 3 which are identical to those of the first embodiment are not redundantly described herein.

In comparison with the first embodiment, the buffering structure 304 comprises plural ribs 3041. The plural ribs 3041 are protruded from a bottom surface of the keycap 301. Each key structure 30 further comprises an auxiliary buffering member 305. The auxiliary buffering member 305 is disposed on the elastic element 303. Similarly, the connecting element 302 comprises a first frame 3021 and a second frame 3022. In this embodiment, the plural ribs 3041 are aligned with a second end 30212 of the first frame 3021 or the first end 30221 of the second frame 3022. The auxiliary buffering member 305 comprises plural protrusion posts 3051. The plural protrusion posts 3051 are disposed on the periphery part 3032 of the elastic element 303 and protruded upwardly from the periphery part 3032.

In an embodiment, the buffering structure 304 is integrally formed with the keycap 301. Alternatively, after the keycap 301 and the buffering structure 304 are separately produced, the keycap 301 and the buffering structure 304 are combined together. Preferably but not exclusively, the buffering structure 304 is formed on the keycap 301 by using a double injection process, a screen printing process, a transfer printing process, a dispensing process or an adhesive attaching process. In an embodiment, the auxiliary buffering member 305 is integrally formed with the elastic element 303. Alternatively, after the auxiliary buffering member 305 and the elastic element 303 are separately produced, the auxiliary buffering member 305 and the elastic element 303 are combined together.

Figure 15:
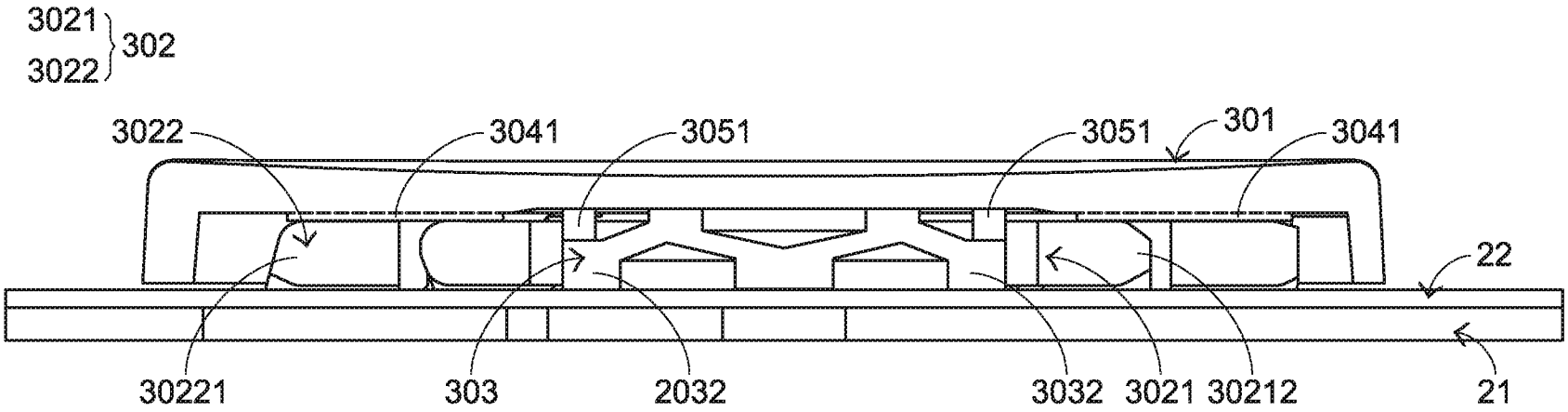
FIG. 15 is a schematic cross-sectional view illustrating a portion of the keyboard device as shown in FIG. 11, in which the keycap of the key structure is depressed.

FIG. 15 is a schematic cross-sectional view illustrating a portion of the keyboard device as shown in FIG. 11, in which the keycap of the key structure is depressed. While the keycap 301 of any key structure 30 is depressed and moved downwardly relative to the base plate 31, the first frame 3021 and the second frame 3022 of the connecting element 302 are switched from the open-scissors state to the stacked state. Moreover, as the keycap 301 is moved downwardly to compress the elastic element 303, the corresponding membrane switch 321 of the membrane circuit board 32 is pushed and triggered by the contacting part 3033 of the elastic element 303. Consequently, the keyboard device 3 generates a corresponding key signal.

Especially, while the keycap 301 of the key structure 30 is depressed and moved downwardly relative to the base plate 31, the buffering structure 304 on the bottom surface of the keycap 301 is moved downwardly with the keycap 301. Correspondingly, the plural ribs 3041 collide with the second end 30212 of the first frame 3021 of the connecting element 302 or the first end 30221 of the second frame 3022 of the connecting element 302. At the same time, the downwardly-moved keycap 301 collides with the plural protrusion posts 3051 of the auxiliary buffering member 305. As a consequence, the impact of the keycap 301 on the membrane circuit board 32 and the generated kinetic energy can be alleviated. Since the sound is reduced while the keycap 301 is depressed, the keyboard device 3 has the noise reducing function.

It is noted that numerous modifications and alterations may be made while retaining the teachings of the invention. For example, the shape and structure of the elastic element 303, the shape and structure of the buffering structure 304, the shape and structure of the auxiliary buffering member 305 and the relative positions between the elastic element 303, the buffering structure 304 and the auxiliary buffering member 305 in the depressed state may be modified according to the practical requirements. For example, the buffering structure 304 and the auxiliary buffering member 305 in the second embodiment may be applied to the keyboard device 2 of the first embodiment in order to increase the buffering and noise-reducing efficacy.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all modifications and similar structures.

What is claimed is:

1. A keyboard device, comprising:

a membrane circuit board comprising a membrane switch;

a base plate located under the membrane circuit board; and a key structure comprising:

a keycap located over the membrane circuit board;

a connecting element connected between the base plate and the keycap, wherein the keycap is movable upwardly or downwardly relative to the base plate through the connecting element;

an elastic element arranged between the keycap and the membrane circuit board, and comprising a contacting part, wherein while the keycap is depressed, the elastic element is compressed and the membrane switch is triggered by the contacting part, wherein when the keycap is not depressed, the keycap is returned to an original position in response to an elastic force of the elastic element; and a buffering structure disposed on a bottom surface of the keycap, wherein while the keycap is depressed, the buffering structure collides with the elastic element or the connecting element, so that the buffering structure provides a buffering effect, wherein the buffering structure is a rib, which is protruded downwardly from the bottom surface of the keycap and aligned with an end of the connecting element, wherein while the keycap is depressed, the rib collides with the end of the connecting element.

2. The keyboard device according to claim 1, wherein the buffering structure is formed on the keycap by using a double injection process, a screen printing process, a transfer printing process, a dispensing process or an adhesive attaching process.

3. The keyboard device according to claim 1, wherein the key structure further comprises an auxiliary buffering member, which is disposed on the elastic element, wherein while the keycap is depressed, the keycap collides with the auxiliary buffering member, so that the buffering effect is provided.

4. The keyboard device according to claim 1, wherein the auxiliary buffering member comprises at least one protrusion post, wherein the at least one protrusion post is disposed on a periphery part of the elastic element and protruded upwardly from the periphery part.

5. The keyboard device according to claim 1, wherein the membrane circuit board further comprises an upper film layer and a lower film layer, wherein a first circuit pattern is formed on the upper film layer, a second circuit pattern is formed on the lower film layer, the first circuit pattern comprises an upper contact, and the second circuit pattern comprises a lower contact, wherein the upper contact and the lower contact are separated from each other by a spacing distance and collectively defined as the membrane switch.

6. The keyboard device according to claim 5, wherein the membrane circuit board further comprises an intermediate film layer between the upper film layer and the lower film layer, so that the upper contact and the lower contact are separated from each other by the spacing distance, wherein the intermediate film layer comprises a perforation corresponding to the upper contact and the lower contact.

7. The keyboard device according to claim 1, wherein the connecting element comprises:

a first frame, wherein a first end of the first frame is connected with the keycap, and a second end of the first frame is connected with the base plate; and a second frame connected with the first frame and swung relative to the first frame, wherein a first end of the second frame is connected with the base plate, and a second end of the second frame is connected with the keycap.

8. The keyboard device according to claim 7, wherein the keycap further comprises a fixed hook and a movable hook, wherein the fixed hook is connected with the first end of the first frame, and the movable hook is connected with the second end of the second frame, so that the second end of the second frame is movable within the movable hook.

9. The keyboard device according to claim 7, wherein the base plate comprises a plate body, a first base plate hook and a second base plate hook, wherein the plate body is located under the membrane circuit board, and the first base plate hook and the second base plate hook are protruded upwardly from the plate body and penetrated through the membrane circuit board, wherein the first base plate hook is connected with the first end of the second frame, and the second base plate hook is connected with the second end of the first frame.

10. A keyboard device, comprising:

a membrane circuit board comprising a membrane switch;

a base plate located under the membrane circuit board; and a key structure comprising:

a keycap located over the membrane circuit board;

a connecting element connected between the base plate and the keycap, wherein the keycap is movable upwardly or downwardly relative to the base plate through the connecting element;

an elastic element arranged between the keycap and the membrane circuit board, and comprising a contacting part, wherein while the keycap is depressed, the elastic element is compressed and the membrane switch is triggered by the contacting part, wherein when the keycap is not depressed, the keycap is returned to an original position in response to an elastic force of the elastic element; and a buffering structure disposed on a bottom surface of the keycap, wherein while the keycap is depressed, the buffering structure collides with the elastic element or the connecting element, so that the buffering structure provides a buffering effect;

wherein the connecting element comprises:

a first frame, wherein a first end of the first frame is connected with the keycap, and a second end of the first frame is connected with the base plate; and a second frame connected with the first frame and swung relative to the first frame, wherein a first end of the second frame is connected with the base plate, and a second end of the second frame is connected with the keycap, and wherein the keycap further comprises a fixed hook and a movable hook, wherein the fixed hook is connected with the first end of the first frame, and the movable hook is connected with the second end of the second frame, so that the second end of the second frame is movable within the movable hook.

11. The keyboard device according to claim 10, wherein the buffering structure is a ring-shaped structure, which is protruded downwardly from the bottom surface of the keycap and comprises a hollow part and an outer ring, wherein the elastic element is penetrated through the hollow part and contacted with the keycap, wherein while the keycap is depressed, the outer ring collides with the elastic element.

* * * * *